US005326089A

United States Patent [19]

Toyoda

[11] Patent Number: 5,326,089

[45] Date of Patent: Jul. 5, 1994

[54] ROTATABLE-CASSETTE-TYPE FEEDING DEVICE FOR USE IN IMAGE FORMING APPARATUS

[75] Inventor: Masashi Toyoda, Yamatokoriyama, Japan

[73] Assignee: Sharp Kabushiki Kaisha, Osaka, Japan

[21] Appl. No.: 957,891

[22] Filed: Oct. 8, 1992

[30] Foreign Application Priority Data

Oct. 18, 1991 [JP] Japan ..... 3-270889

[51] Int. Cl.[5] ..... G03G 21/00; B65H 1/00

[52] U.S. Cl. ..... 271/162; 271/9; 355/208; 355/311

[58] Field of Search ..... 355/309, 308, 311, 75, 355/204, 208; 271/9, 145, 162

[56] References Cited

U.S. PATENT DOCUMENTS 5,003,493 3/1991 Okada et al. ..... 355/311 X
5,028,042 7/1991 Yamada et al. ..... 271/9
5,052,671 10/1991 Matsuo ..... 271/9
5,217,217 6/1993 Matsumoto ..... 355/308 X

FOREIGN PATENT DOCUMENTS 0397477 11/1990 European Pat. Off. ..... 271/9
0398659 11/1990 European Pat. Off. ..... 271/9
56-59245 5/1981 Japan .
56-59251 5/1981 Japan .

*Primary Examiner*—A. T. Grimley
*Assistant Examiner*—Shuk Y. Lee

[57] ABSTRACT

A rotatable-cassette-type feeding device, for use in an image forming apparatus for forming images on sheets of paper, has a paper cassette for housing sheets of paper. This paper cassette can be rotated either to the longitudinal feeding station or to the lateral feeding station of the sheets of paper by a driving motor. The rotatable-cassette-type feeding device is provided with drive control means for controlling the driving motor in its rotation speed in such a manner that, during a state in which no copying process is required, the paper cassette is rotated at a speed that is lower than that marked during an copying operation. Thus, when the rotatable cassette is driven during the stand-by state, the motor is rotated at a low speed. Thus, it is possible to reduce noise that is generated from the driving system and the motor of the rotatable cassette, thereby making the device quieter.

14 Claims, 11 Drawing Sheets

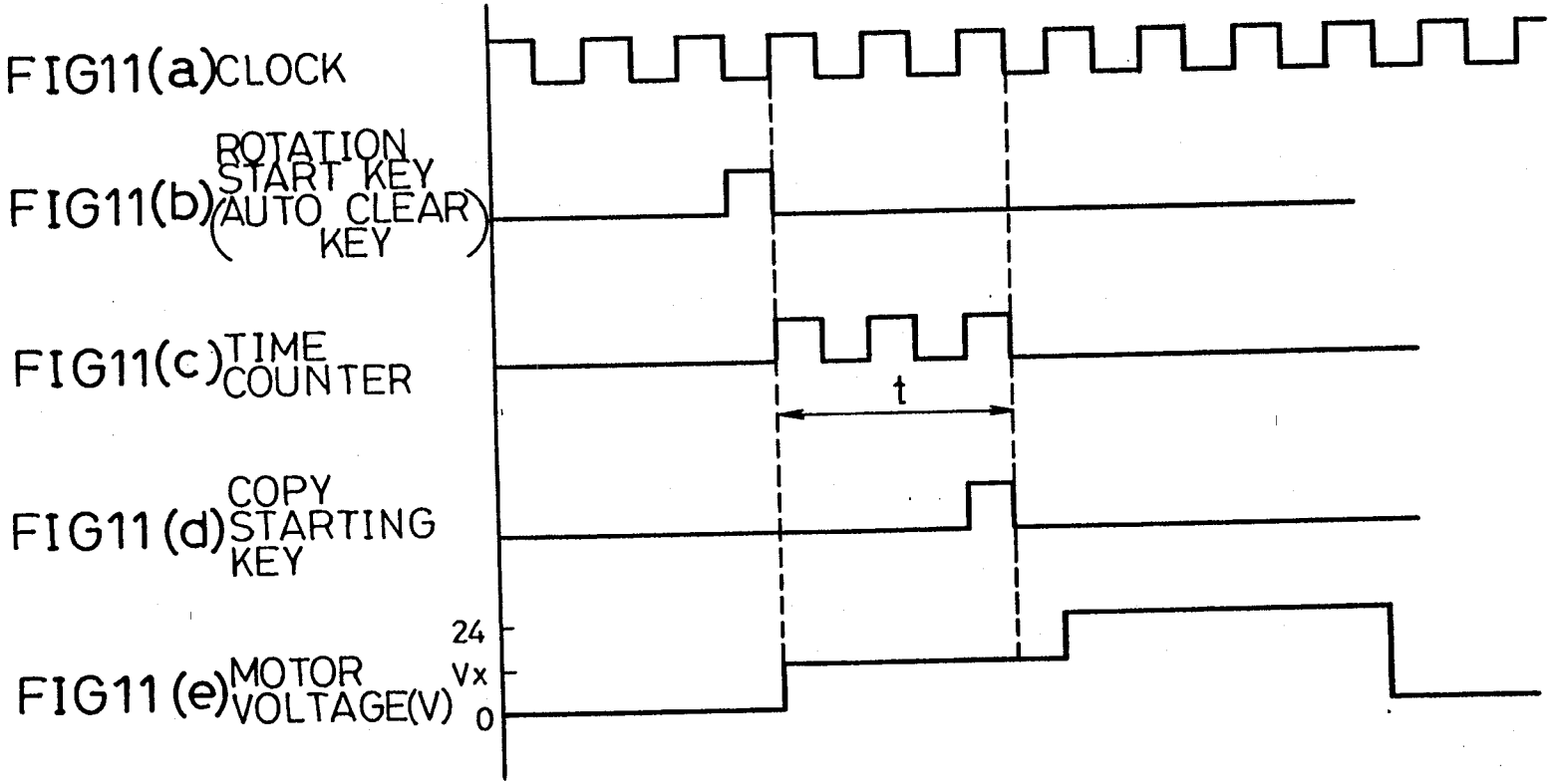
FIG11(a)CLOCK
FIG11(b)ROTATION START KEY (AUTO CLEAR KEY)
FIG11(c)TIME COUNTER
FIG11(d)COPY STARTING KEY
FIG11(e)MOTOR VOLTAGE(V)
t
24
Vx
0

ROTATABLE-CASSETTE-TYPE FEEDING DEVICE FOR USE IN IMAGE FORMING APPARATUS

FIELD OF THE INVENTION

The present invention relates to a rotatable-cassette-type feeding device for use in, for example, a copying machine as an image forming apparatus, wherein a paper cassette is adapted to be rotated either to a longitudinal feeding station or to a lateral feeding station.

BACKGROUND OF THE INVENTION

Conventionally, a paper feeding device for supplying sheets of paper whereon images from originals are transferred is provided in a copying machine. In such a feeding device, it is required to provide a function for supplying sheets of paper of a plurality of sizes in order to meet various sizes and copying operations such as a magnifying copying operation and a reducing copying operation.

As shown in explanatory drawings of the present invention, FIGS. 2 and 3, for the purpose of effective supply and exchange of sheets of paper, some of the conventional feeding devices of this type have a rotatable cassette 6 in each of rotatable cassette units 3 and 4 that are installed in the lower portion of a copying machine main body 1. Each of the cassette units 3 and 4 has a motor 7 in its lower portion as a power supply source for rotating the rotatable cassette 6, and thus the rotatable cassette 6 is rotated by the driving force of the motor 7. Further, sheets of paper of A-4 size are placed into the rotatable cassette 6 in the rotatable cassette unit 3, and by rotating the rotatable cassette 6, it is possible to feed the sheets of paper of A-4 size either in the longitudinal feeding direction or in the lateral feeding direction. In the above-mentioned rotatable-cassette-type feeding device, rotation of the rotatable cassette 6 is executed at a high speed in order to permit the copying machine to start its copying operation in a short time.

However, in the above-mentioned conventional rotatable-cassette-type feeding device, speed of the rotating operation is the same in both of the cases when the rotating operation is executed during a state wherein no copying operation is required and when it is executed during a copying operation. Therefore, during the state wherein no copying operation is required, when the rotatable cassette 6 is driven to rotate to a predetermined initial station, for example, by a turning-on operation of an auto-clear key, a problem is presented in that big noise is generated from the motor 7 and the driving system due to the rotating operation.

SUMMARY OF THE INVENTION

It is an object of the present invention to provide a rotatable-cassette-type feeding device for use in an image forming apparatus, wherein it is possible to reduce noise that is generated from the driving system such as the motor when the rotatable cassette is driven during the state wherein no copying operation is required.

In order to solve the above problems, the rotatable-cassette-type feeding device of the present invention, for use in an image forming apparatus for forming images on sheets of paper, is provided with the following means:

(a) paper accommodation means for housing sheets of paper, which is freely rotated either to a longitudinal feeding station for feeding the sheets of paper to the image forming apparatus in the length-wise direction, or to a lateral feeding station for feeding the sheets of paper thereto in the width-wise direction;

(b) rotation driving means for rotating the paper accommodation means between its longitudinal feeding station and lateral feeding station of the sheets of paper;

(c) drive control means for controlling the rotation driving means in its rotation speed in such a manner that, during a state wherein no image forming process is required, the paper cassette is rotated at a speed which is lower than that marked during an image forming operation.

With the above arrangement, the drive control means controls the rotation driving means in its rotation speed in such a manner that, during a state in which no image forming process is required, the paper cassette is rotated at a speed which is lower than that marked during an image forming operation; therefore, when the paper cassette is driven during the state in which no image forming process is required, the driving motor is rotated at a low speed. Thus, noise generated from the driving system of the paper cassette and the driving motor can be reduced, thereby making the device quieter.

Further, the drive control means controls the driving operation of the rotation driving means in such a manner that comparison is made between the time gap between starts, which is a period of time from the start of the rotation of the rotation driving means to the start of the preparatory processes, and the setting time that is set based on the difference between the time required for the rotation between longitudinal and lateral feeding stations in the paper accommodation means and the time required for the preparatory processes and that, if the time gap between starts is shorter than the setting time, the paper accommodation means is rotated at a normal speed, whereas, if the time gap between starts is longer than the setting time, the paper accommodations means is rotated at a speed lower than the normal speed. Thus, when a copying operation is called for during the stand-by state, it is possible either to make the paper accommodation means quieter in its rotating operation or to avoid the drawback of increased waiting time for the start of the copying operation depending on each situation by controlling the rotation speed of the paper accommodation means according to the time difference of the time gap between starts and the setting time.

For a fuller understanding of the nature and advantages of the invention, reference should be made to the ensuing detailed description taken in conjunction with the accompanying drawings.

BRIEF DESCRIPTION OF THE DRAWINGS

FIG. 11 is a timing chart indicating timing for the switching of the rotation speed of the rotatable cassette in the rotatable-cassette-type feeding device.

DESCRIPTION OF THE EMBODIMENTS

Embodiment 1

Referring to FIGS. 1 through 6, the following description will discuss one embodiment of the present invention. Here, the present embodiment will discuss a case where a rotatable-cassette type feeding device is employed in a copying machine as an image forming apparatus.

Figure 2:
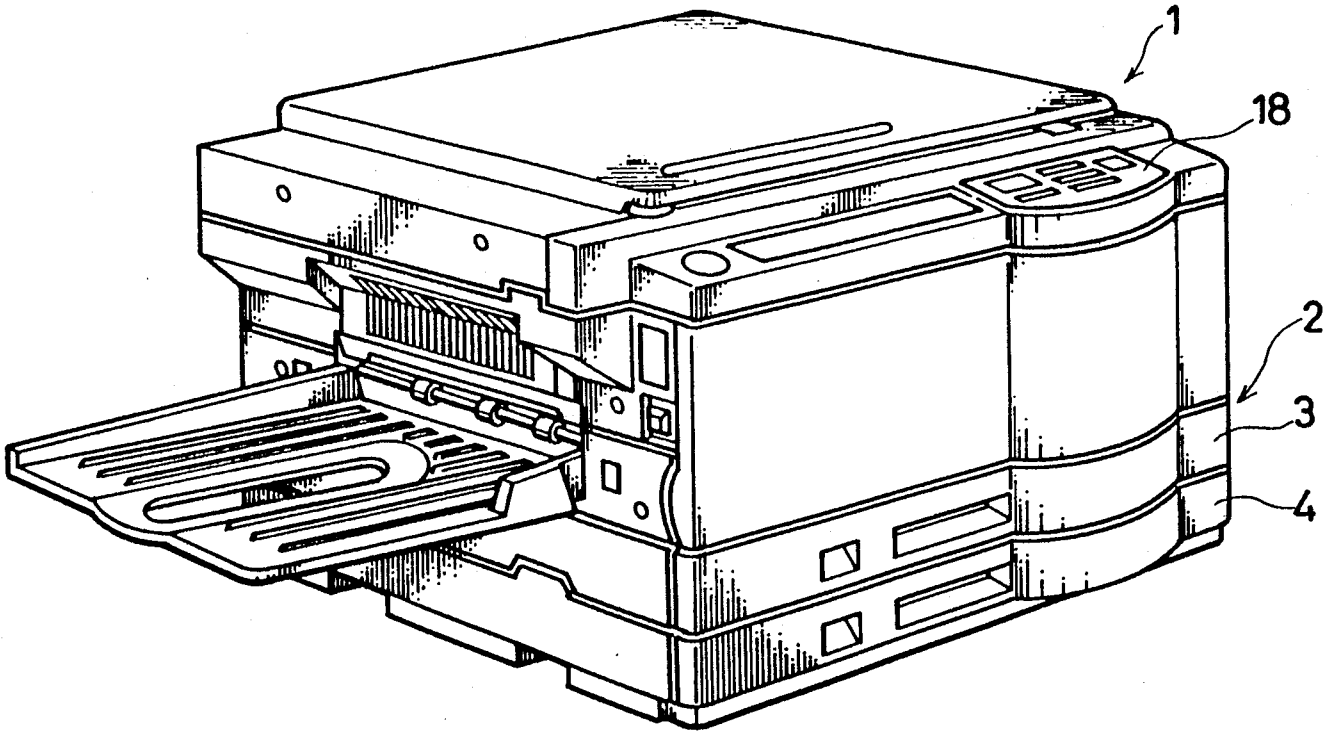
FIG. 2 is a perspective view of a copying machine that is provided with the above-mentioned rotatable-cassette-type feeding device.
Figure 3:
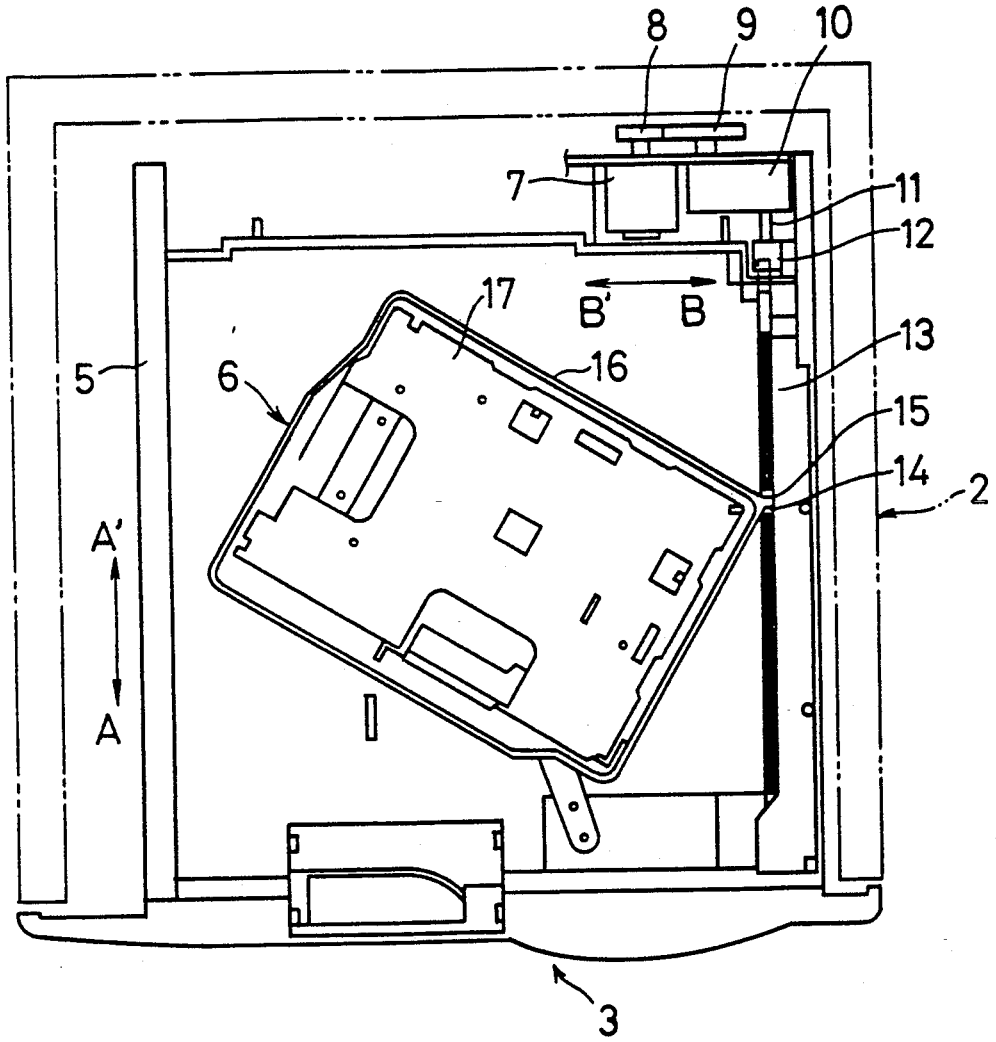
FIG. 3 is a plan view indicating a rotatable cassette unit of the rotatable-cassette-type feeding device.

As illustrated in FIG. 2, the rotatable-cassette type feeding device of the present embodiment is installed in the lower portion of a copying machine main body 1, and provided with a feeding device main body 2 having rotatable cassette units 3 and 4. As illustrated in FIG. 3, the rotatable cassette unit 3 has a cassette housing 5, which is a housing section of the rotatable cassette unit 3, and a rotatable cassette 6 (paper accommodation means), which is placed in the cassette housing 5. The rotatable cassette unit 3 is supported to a feeding device main body 2 by a sliding mechanism, not shown, which is disposed between the housing portion of the feeding device main body 2 and the cassette housing 5, in such a manner that it can be attached to the feeding device main body 2 in a direction indicated by A', and removed therefrom in a direction indicated by A.

The feeding device main body 2 has a motor 7 serving as a power source for rotating the rotatable cassette 6, and the power from the motor 7 is transmitted to a rotative threaded shaft 13 in the rotatable cassette unit 3 through gears 8 and 9, a reducer 10, a rotating shaft 11 and a coupling clutch 12. The rotative threaded shaft 13 having a thread in its peripheral surface so as to shift a movable joint 14 to be described later, is rotatably disposed in a direction A—A' by being coupled to a coupling clutch 12 at one corner of the cassette housing 5. The movable joint 14 is meshed with the rotative threaded shaft 13, and adapted to move along the rotative threaded shaft 13 according to the rotation of the rotative threaded shaft 13. The movable joint (nut member) 14 is connected to one corner of the rotatable cassette 6 at a cassette connecting point 15.

Additionally, the motor 7, the gears 8 and 9, the reducer 10, the rotating shaft 11, the coupling clutch 12, the threaded shaft 13 and the movable joint 14 constitute a rotation driving means of the present invention.

The rotatable cassette 6 has a paper holding plate 17 in its outside case 16. The rotatable cassette 6 houses sheets of paper of A-4 size, which is one of the sizes of the sheets of paper, and is capable of freely switching the feeding direction of the sheets of paper of this A-4 size between the longitudinal feeding direction and the lateral feeding direction by rotating the rotatable cassette 6. Additionally, the rotatable cassette unit 4, located in the lower portion of the feeding device main body 2, houses sheets of paper of B-5 size. The paper holding plate 17 is arranged in such a manner that, when the rotatable cassette 6 is disposed in a longitudinal feeding station (wherein the lengthwise direction of the rotatable cassette 6 coincides with the direction B) or in a lateral feeding station (wherein the lengthwise direction of the rotatable cassette 6 coincides with the direction A), the end portion thereof in the direction B is driven by a paper holding plate raising mechanism, not shown, and raised so as to permit a feeding operation.

The rotatable cassette units 3 and 4 have respective sensors, not shown. According to the output of each sensor, the state of each of the rotatable cassette units 3 and 4 is detected as to whether it is attached to the feeding device main body 2 or not and the state of the rotatable cassette 6 is also detected as to whether it is in the longitudinal feeding station or in the lateral feeding station or it is in rotation.

Furthermore, besides the feeding device main body 2, the copying machine of the present invention has another feeding device in its main body 1. This feeding device (hereinafter, referred to as separate feeding device) is used for feeding sheets of paper of larger sizes such as A-3 size and B-4 size.

Figure 4:
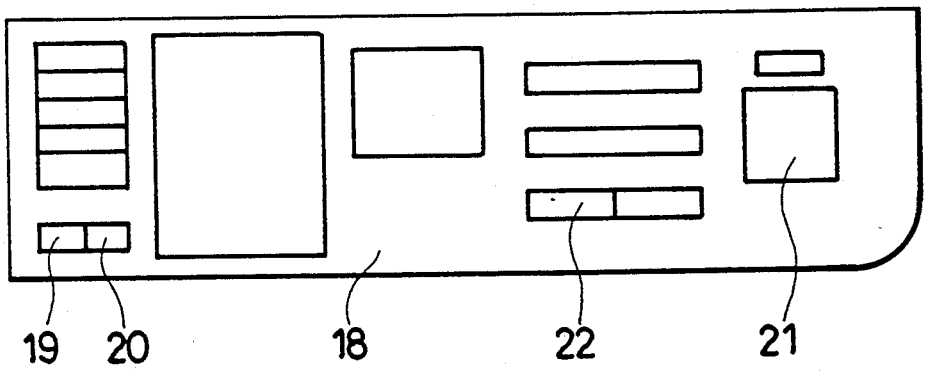
FIG. 4 is a plan view indicating an operation section of the copying machine provided with the rotatable-cassette-type feeding device.

On the other hand, as shown in FIG. 4, the copying machine main body 1 is provided with an operation section 18. The operation section 18 includes a paper selection key 19 as a selection input means, a rotation starting key 20 as a rotation start input means, a copy starting key 21, an auto-clear key 22 and other keys.

Each time the paper selection key 19 is depressed, the size of the sheets of paper is properly selected and the feeding direction thereof is properly selected (between the longitudinal feeding direction and the lateral feeding direction). Thus, selection is made from either A-4 size or B-5 size of sheets of paper that are stored in the respective rotatable cassette units 3 and 4. Also, selection is made from either A-3 size or B-4 size of sheets of paper that are stored in the separate feeding device.

The rotation starting key 20 is a key for starting the rotation of the rotatable cassette 6 so as to set it in the desired direction when either of the sizes of the sheets of paper stored in the rotatable cassette units 3 and 4 is selected through the paper selection key 19.

The copy starting key 21 is a key for starting a copying operation. When this copy starting key 21 is depressed, a copying operation is started after a rotating operation of the rotatable cassette 6 having been conducted, even if the selected sheets of paper is not set in the feeding direction. If the selected sheets of paper is set in the feeding direction, a copying operation is immediately started.

The auto-clear key 22 is a key for giving an instruction so that the rotatable cassette 6 is rotatively set in the predetermined feeding direction, that is, at an initial station. Here, the rotatable cassette 6 containing sheets of paper of A-4 size is set in the lateral feeding station as its initial station; whereas, the rotatable cassette 6 containing sheets of paper of B-5 size is set in the longitudinal feeding station as its initial station.

Moreover, the copying machine of the present invention has a control section as a drive control means for providing rotation control the rotatable cassette 6 by driving the motor 7.

Figure 5:
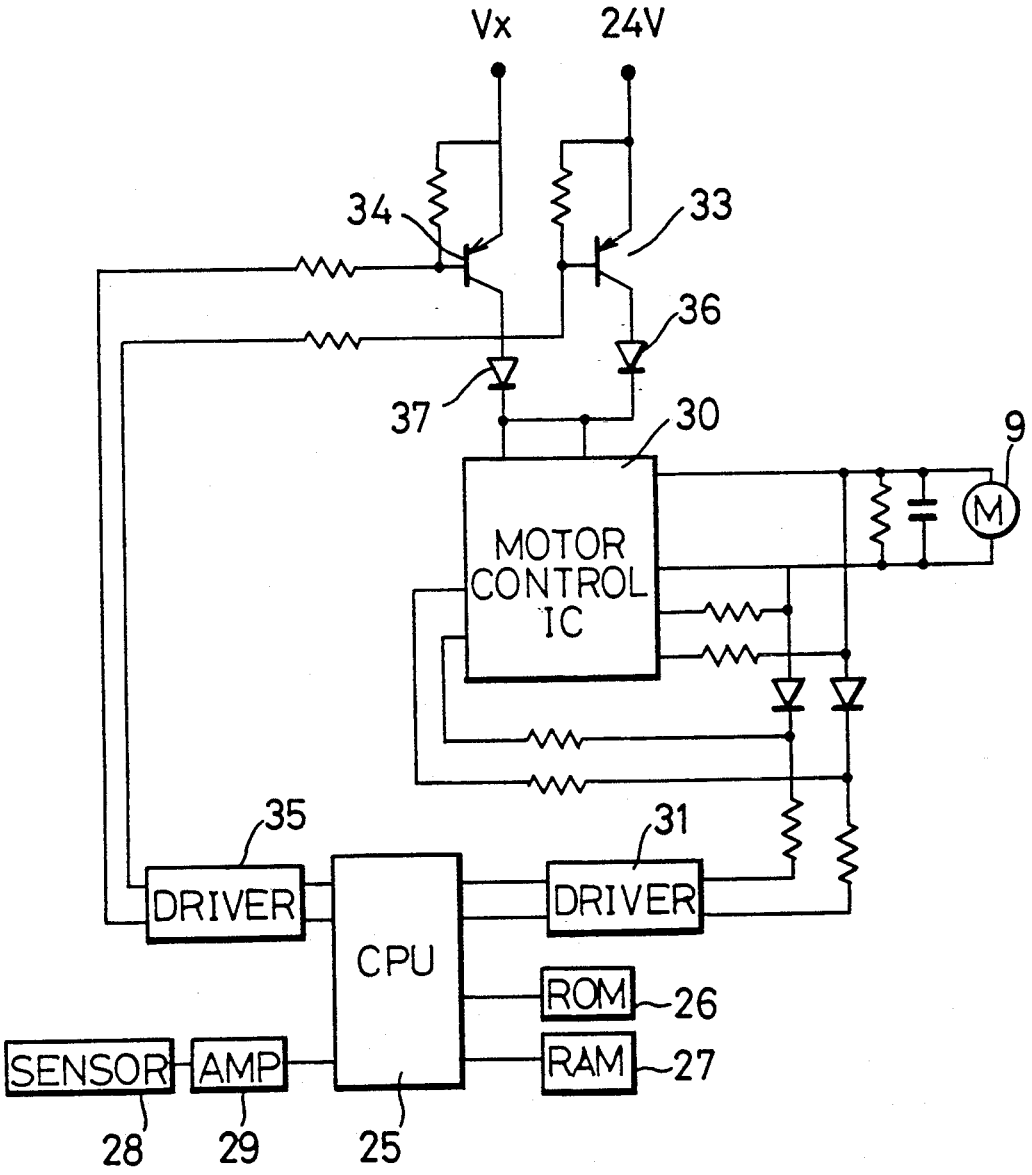
FIG. 5 is a circuit diagram indicating a control section of the rotatable-cassette-type feeding device.

As illustrated in FIG. 5, the control section is constituted of a CPU 25 (Central Processing Unit) for use as power source switching means, a ROM 26 (Read Only Memory) for storing various programs and data, a RAM 27 (Random Access Memory) for memorizing sheets of paper selected through the paper selection key 19, an AMP 29 (Amplifier) for amplifying a detection signal from a sensor 28, which detects the station of the rotatable cassette 6, and releasing it to the CPU 25, a motor control IC 30 for controlling the rotation of the motor 7, a driver 31 for driving the motor control IC 30 according to an output signal from the CPU 25, and a driver 35 for driving transistors 33 and 34 according to the output signal from the CPU 25.

The emitter of the transistor 33 is connected to a power source having 24 V as the first power source and the collector thereof is connected to the motor control IC 30 through a diode 36. Further, the emitter of the transistor 34 is connected to a variable power source as the second power source, while the collector thereof is connected to the motor control IC 30 through a diode 37.

Figure 6:
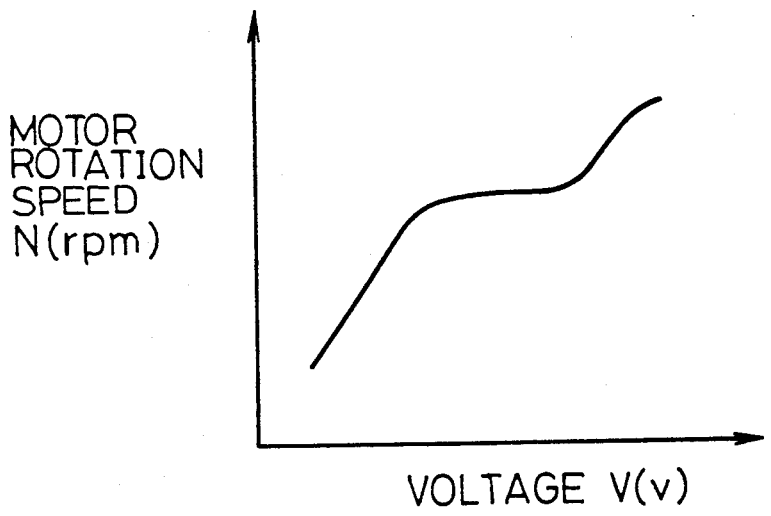
FIG. 6 shows a characteristic curve indicating the relationship between the rotation speed and the voltage of a motor in the rotatable-cassette-type feeding device.

The CPU 25 is arranged so that, during a copying operation, the motor 7 is rotated at a normal speed by switching the supply voltage for the motor 7 to the 24 V side, which is a rated voltage; whereas, during a state wherein no copying operation required, the motor 7 is rotated at a speed lower than the normal speed by switching the supply voltage to a voltage $V_x$ that is lower than 24 V. More specifically, as illustrated in FIG. 6, the motor 7 has a rotation characteristic wherein the rotation speed decreases as the voltage is lowered. For this reason, by lowering the driving voltage of the motor 7, it is possible to rotate the motor 7 at a low speed, and thus it is also possible to rotate the motor 7 with a minimum of driving sound of the motor 7 and rotation sound of the rotatable cassette 6.

Figure 1:
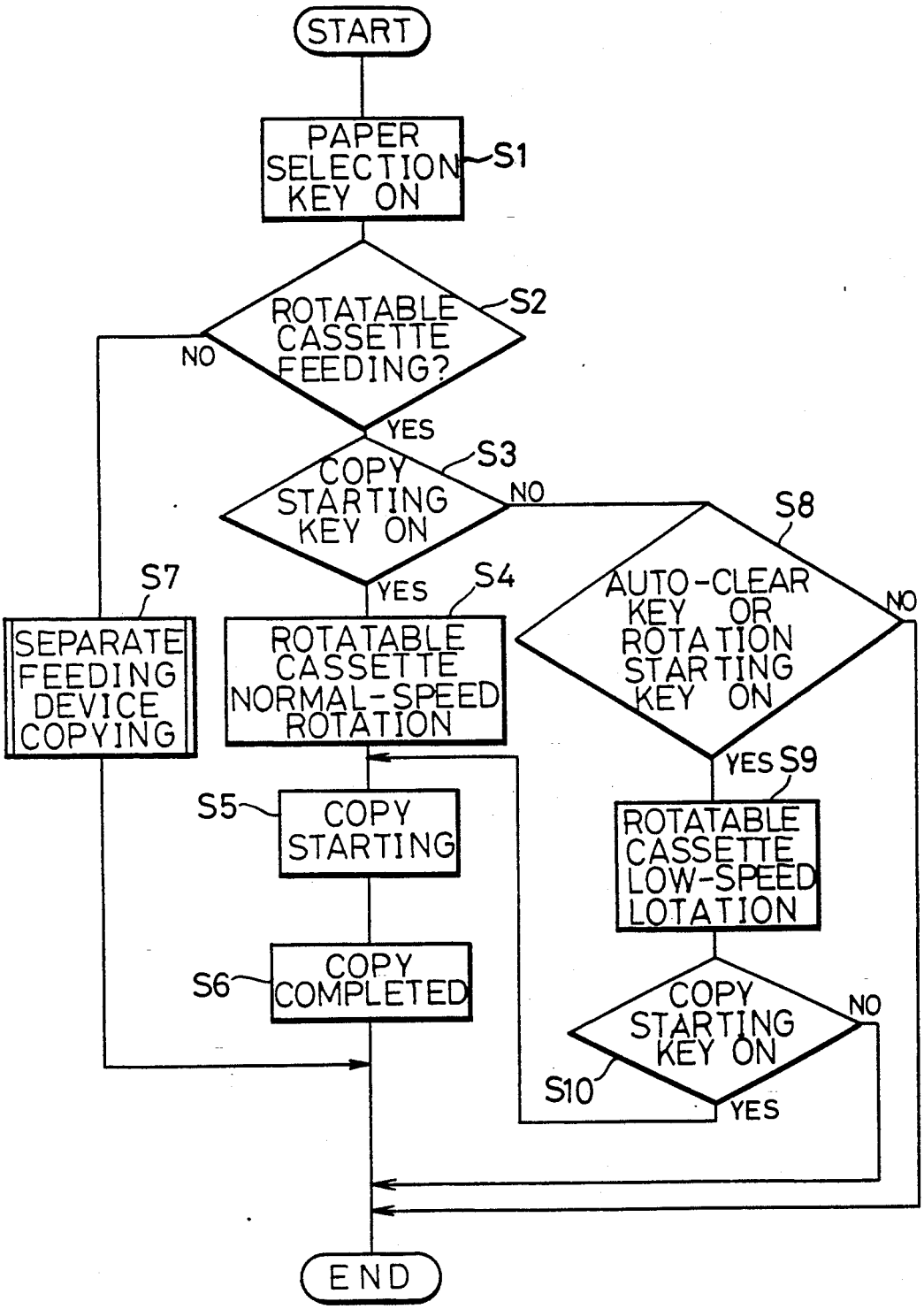
FIG. 1 is a flow chart indicating a rotation control of a rotatable cassette in a rotatable-cassette-type feeding device of an image forming apparatus that is exemplified in one embodiment of the present invention.

Referring to a flow chart of FIG. 1, an explanation will be given on the rotation control operation of the rotatable-cassette-type feeding device of the present copying machine having the above arrangement.

First, by depressing the paper selection key 19, a desired paper size and feeding direction is selected (S1). When the desired paper size and feeding direction is determined at S1, the CPU 25 of the control section makes a judgement as to which feeding operation is required, a feeding operation from the rotatable cassette 6 or that from the separate feeding device (S2). If it is judged that the feeding operation from the rotatable cassette 6 is required, the CPU 25 further makes a judgement as to whether or not the copy starting key 21 has been depressed (S3). On the other hand, if it is judged at S2 that the feeding operation from the separate feeding device is required, a feeding operation from the separate feeding device is executed; a copying operation is started, and then completed (S7).

If the copy starting key 21 has been depressed at S3, the rotatable cassette 6 is rotated at the normal speed by setting the driving voltage of the motor 7 at the rated voltage of 24 V according to the control signal from the CPU 25 (S4). Then, a copying operation is started (S5), and soon the copying operation is completed (S6).

On the other hand, if the auto-clear key 22 or the rotation starting key 20 has been depressed instead of depressing the copy starting key 21 at S3 (S8), the rotatable cassette 6 is rotated at a lower speed by rotating the motor 7 at a speed lower than the normal speed through the function of the CPU 25 that switches the driving voltage of the motor 7 to the voltage $V_x$ that is lower than 24 V (S9). Furthermore, if the copy starting key 21 is depressed after the rotatable cassette 6 has been rotated at the lower speed (S10), a copying operation is started (S5), and soon the copying operation is completed (S6).

As described above, in the rotatable-cassette-type feeding device of the present embodiment, the CPU 25 controls the rotation speed of the motor 7 in such a manner that, during a state wherein no copying operation is required, the rotatable cassette 6 is rotated at a speed lower than the speed that is required during a copying operation. Thus, when the rotatable cassette 6 is driven during the state wherein no copying operation is required, noise generated from the driving system of the rotatable cassette 6 (for example, the motor 7) can be reduced, thereby making the device quieter.

Embodiment 2

Referring to FIGS. 2 through 4 as well as FIGS. 7 through 11, the following description will discuss another embodiment of the present invention. Here, for convenience of explanation, those members that have the same functions and that have described in the embodiment 1 are indicated by the same reference numerals and the description thereof is omitted.

Figure 7:
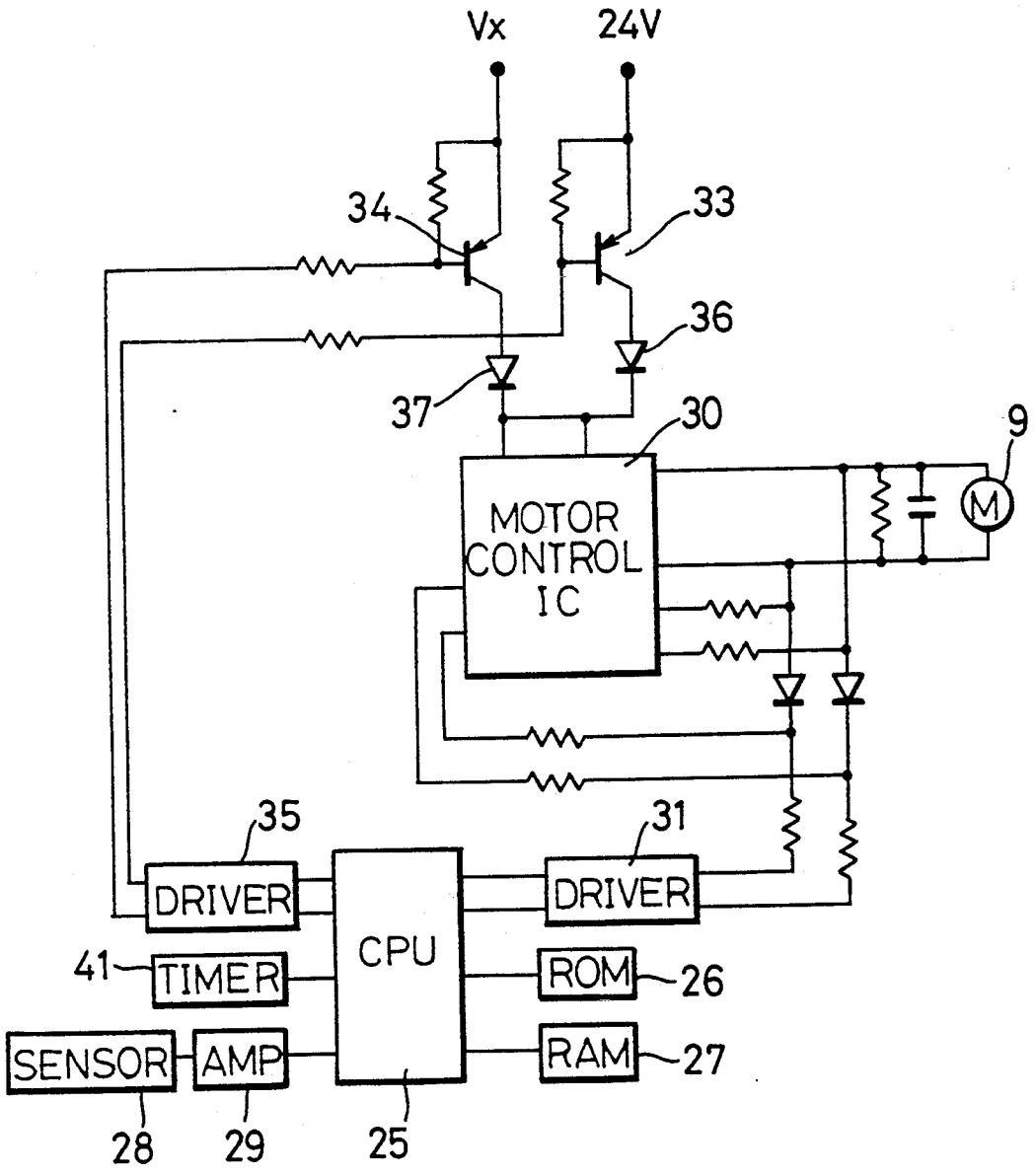
FIG. 7 is a circuit diagram indicating a control section of a rotatable-cassette-type feeding device of an image forming apparatus that is exemplified by another embodiment of the present invention.

As illustrated in FIG. 7, in the control section of the rotatable-cassette-type feeding device of the present embodiment, a timer 41 functioning as a time counting means is connected to the CPU 25. The timer 41 is designed to count time gap t between starts, which is a period of time from the start of the rotation of the motor 7 to the start of preparatory processes for a copying operation. Here, the preparatory process for a copying operation refers to preparatory work on such devices as an exposure device, a charging device, a developing device, and a transfer device, which is performed before the start of a copying operation in order to provide a smooth and good copying operation when a copying operation is called for during the stand-by state.

Moreover, the RAM 27, which functions as a setting time storing means, stores setting time T ($T=t2-t1$) that is set based on a difference between time t2 required for the rotation at a low speed between longitudinal and lateral feeding directions in the rotatable cassette 6 and time t1 required for the preparatory processes.

The CPU 25, which functions as a time comparison means, compares the lengths of the setting time T and the time gap t between starts. Further, if the time gap t between starts is shorter than the setting time T, the CPU 25 controls the motor 7 so that it rotates at the normal rotation speed; whereas, if the time gap t between starts is longer than the setting time T, the CPU 25 controls the motor 7 so that it rotates at a rotation speed lower than the normal rotation speed.

In the above-mentioned arrangement, referring to flow charts of FIGS. 8 through 10, an explanation will be given on the rotation control operation of the present rotatable-cassette-type feeding device.

Figure 8:
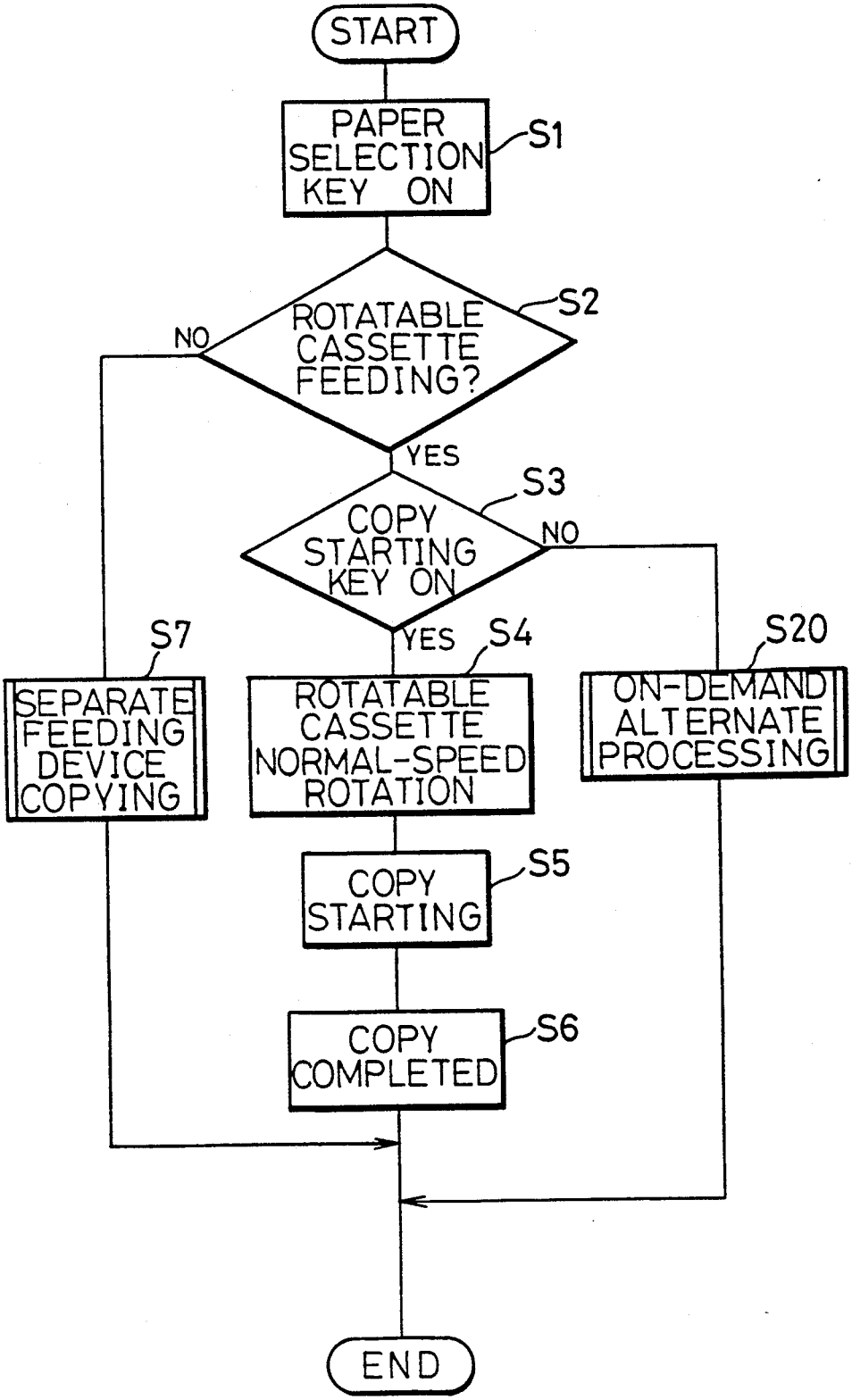
FIG. 8 is a flow chart indicating a main routine of rotation control of the rotatable cassette in the rotatable-cassette-type feeding device.

As illustrated in FIG. 8, if the copy starting key 21 is not depressed at S3, an on-demand alternate-processing routine is executed (S20).

Figure 9:
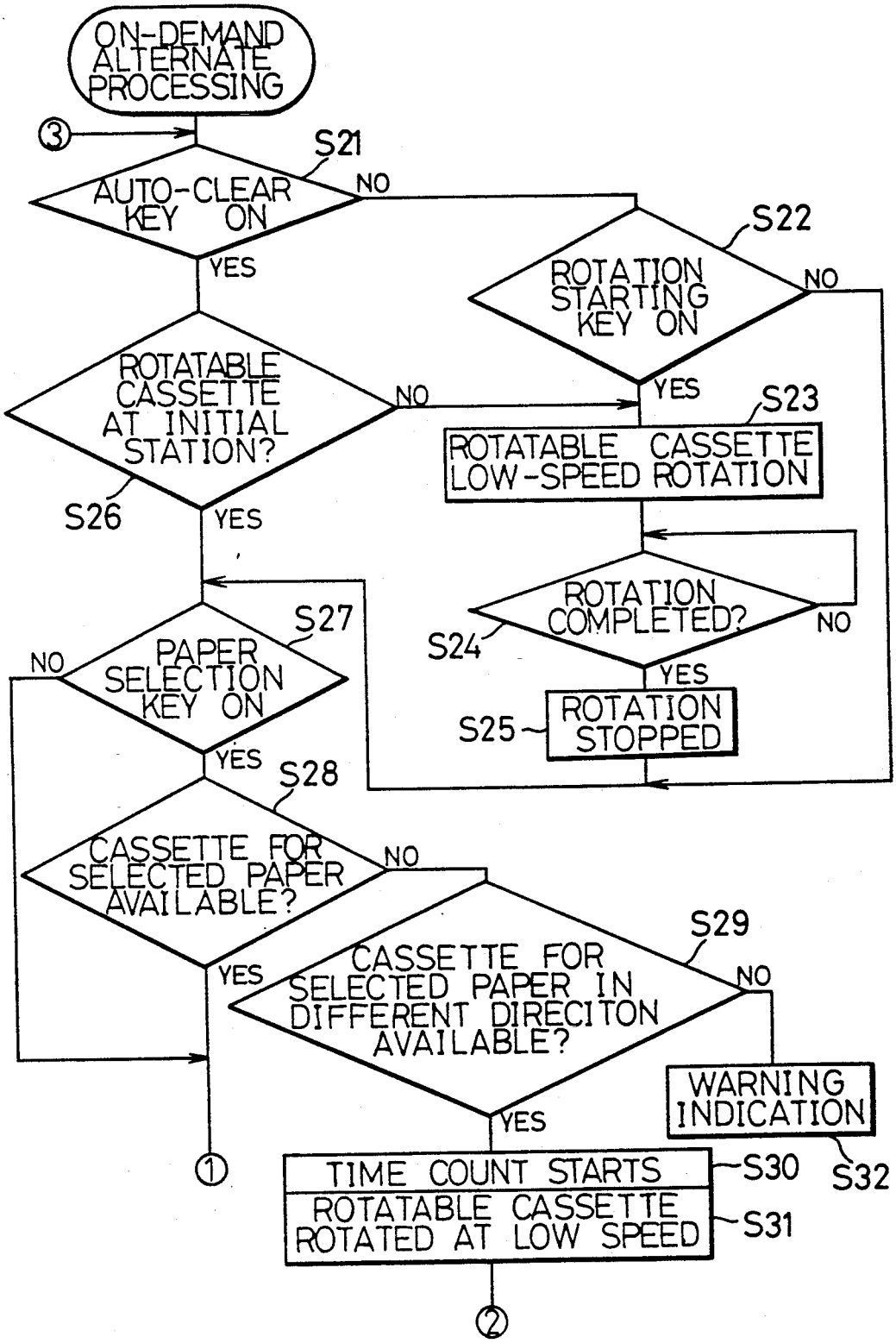
FIG. 9 is a flow chart indicating an on-demand alternate-processing routine .of the rotation control of the rotatable cassette in the rotatable-cassette-type feeding device.

In the on-demand alternate-processing routine, as illustrated in FIG. 9, it is judged whether or not the auto-clear key 22 has been depressed (S21). If the auto-clear key 22 has not been depressed, it is judged whether or not the rotation starting key 20 has been depressed (S22). If the rotation starting key 20 has been depressed at S22, the rotatable cassette 6 is rotated at a low speed (S23), and then it is judged by the CPU 25 whether or not the rotation of the rotatable cassette 6 has been completed (S24). If the rotation has been completed, the rotation of the rotatable cassette 6 is stopped (S25). Thereafter, it is judged whether or not the paper selection key 19 has been depressed again (S27). Moreover, the rotation starting key 20 has not been depressed at S22, the sequence directly proceeds to S27.

On the other hand, if the auto-clear key 22 has been depressed at S21, it is judged by the CPU 25 whether or not the rotatable cassette 6 is located at the initial station (S26). If the rotatable cassette 6 is not located at the initial station at S26, the sequence proceeds to S23 where the rotatable cassette 6 is rotated at a low speed; whereas, if the rotatable cassette 6 is located at the initial station at S26, the sequence proceeds to S27 where it is judged whether or not the paper selection key 19 has been depressed again.

As described above, in the rotatable-cassette-type feeding device of the present embodiment, the rotatable cassette 6 can be rotated to the desired paper feeding station at a low rotation speed by the depressing operation of the auto-clear key 22 or the paper selection key 19. Further, in the present embodiment, an explanation will be given hereinbelow as to how to cope with the case where the paper selection key 19 is depressed again after the rotation has been completed.

If the paper selection key 19 has been depressed again at S27, it is judged by the CPU 25 whether or not the rotatable cassette 6 containing the selected sheets of paper is set in the desired feeding station (S28). If the rotatable cassette 6 containing the selected sheets of paper is not set in the desired feeding station, it is judged whether or not the rotatable cassette 6 is set in the feeding station that is different from the desired paper feeding station of the selected sheets of paper (S29). Then, if the rotatable cassette 6 is set in the feeding station that is different from the desired paper feeding station of the selected sheets of paper, the timer 41 starts counting (S30) and the rotatable cassette 6 is rotated at a low speed (S31). On the other hand, if the rotatable cassette 6 is not set in the feeding station that is different from the desired paper feeding station of the selected sheets of paper at S29, a warning indication is displayed so as to give attention to the fact that the selected sheets of paper are not placed in the copying machine (S32).

Figure 10:
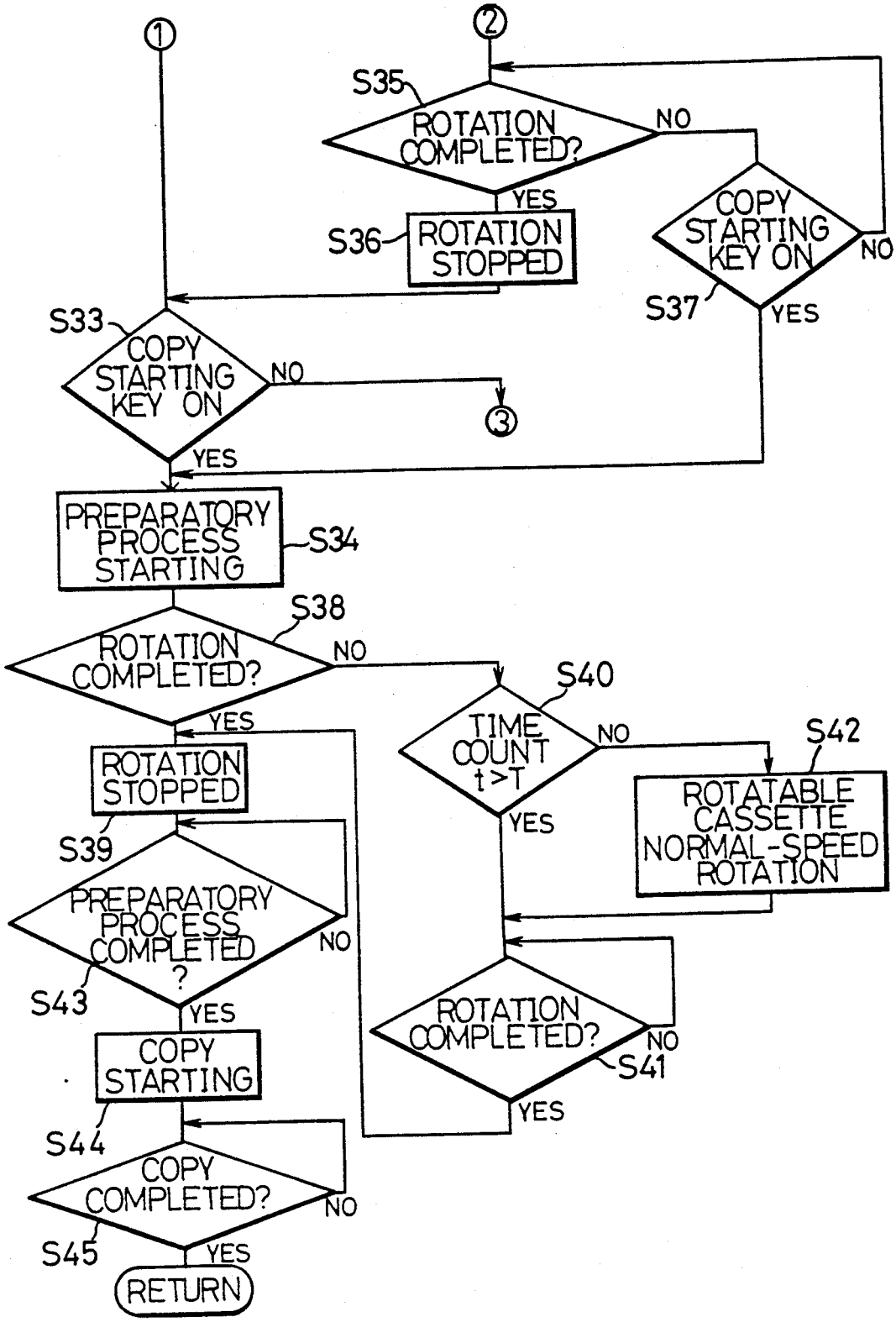
FIG. 10 is a continuation of FIG. 9, which indicates an on-demand alternate-processing routine of the rotation control of the rotatable cassette in the rotatable-cassette-type feeding device.

If the rotatable cassette 6 containing the selected sheets of paper is set in the desired feeding station at S28, it is judged whether or not the copy starting key 21 has been depressed, as shown in FIG. 10 (S33). Then, if the copy starting key 21 has been depressed, the preparatory processes are started (S34). Here, if the copy starting key 21 has not been depressed at S33, the sequence returns to S21.

On the other hand, after the rotatable cassette 6 has been rotated at a low speed at S31, it is judged whether or not the rotation of the rotatable cassette 6 has been completed (S35). If the rotation of the rotatable cassette 6 has been completed, the rotation of the rotatable cassette 6 is stopped (S36) and the sequence returns to S33. Further, if the rotation of the rotatable cassette 6 has not been completed at S35, it is judged whether or not the copy starting key 21 has been depressed again (S37). Here, if the copy starting key 21 is depressed, the sequence returns to S34 where the preparatory processes are started. If the copy starting key 21 has not been depressed at S37, the sequence returns to S35.

Successively, after the preparatory processes have been started at S34, it is judged whether or not the rotation of the rotatable cassette 6 has been completed (S38). If the rotation of the rotatable cassette 6 has been completed, the rotation of the rotatable cassette 6 is stopped (S39). On the other hand, if the rotation of the rotatable cassette 6 has not been completed at S38, it is judged by the CPU 25 whether or not the time gap t between starts is longer than the setting time T (S40). Then, if the time gap t between starts is longer than the setting time T, the CPU 25 permits the rotatable cassette 6 to continue its rotation at a low speed. Thereafter, it is judged whether or not the rotation of the rotatable cassette 6 has been completed (S41). If the rotation of the rotatable cassette 6 has been completed, the sequence returns to S39 where the rotation is stopped.

On the other hand, if the time gap t between starts is shorter than the setting time T, the CPU 25 permits the motor 7 to rotate at the normal speed by setting the driving voltage of the motor 7 at the rated voltage of 24 V; thus, the rotatable cassette 6 is rotated at the normal speed (S42). Then, the sequence proceeds to S41.

Successively, after the rotation of the rotatable cassette 6 has been stopped at S39, it is judged whether or not the preparatory processes have been completed (S43). If the preparatory processes have been completed, a copying operation is started (S44). After it has been judged whether or not the copying operation is completed (S45), the on-demand alternate-processing routine is finished. Thereafter, as illustrated in FIG. 8, the sequence returns to the main routine, thereby completing the main routine.

Referring to a time chart in FIG. 11, an explanation will be given on switching timing of the rotation speed of the motor 7, which is indicated in the above-mentioned flow chart.

FIG. 11(*a*) indicates a clock signal. As shown in FIG. 11(*b*), when either the rotation starting key 20 or the auto-clear key 22 is turned on, the timer starts counting as is shown in FIG. 11(*c*). At this time, as shown in FIG. 11(*e*), the motor 7 is driven with the low voltage $V_x$ so as to rotate the rotatable cassette 6 at the low speed. Thereafter, as shown in FIG. 11(*d*), the copy starting key 21 is turned on. At this time, if it is judged by the CPU 25 that the rotation operation of the rotatable cassette has not been completed when the preparatory processes for a copying operation have been completed, the CPU 25 drives the motor 7 with the rated voltage of 24 V as illustrated in FIG. 11(*e*).

As described above, the control section of the rotatable-cassette-type feeding device of the present embodiment is provided with: the timer 41 for counting the time gap t between starts, that is, a period of time from the start of the rotation of the motor 7 to the start of the preparatory processes; the RAM 27 for storing the setting time T that is set based on the difference between the time t2 required for the rotation between longitudinal and lateral feeding stations .in the rotatable cassette 6 and the time t1 required for the preparatory processes; and the CPU 25 as the time comparison means for comparing the lengths of the setting time T and the time gap t between starts that is supplied from the timer 41. In this arrangement, the control section controls the motor 7 so that it rotates at the normal rotation speed if the time gap t between starts is shorter than the setting time T and for controlling the motor 7 so that it rotates at a rotation speed lower than the normal rotation speed if the time gap t between starts is longer than the setting time T, based on the results of the comparison that is made by the time comparison means.

With the above arrangement, when a copying operation is called for during the stand-by state, it is possible either to make the rotatable cassette 6 quieter in its rotating operation or to avoid the drawback of increased waiting time for the start of the copying operation depending on each situation by controlling the rotation speed of the rotatable cassette 6 according to the time difference of the time gap between starts and the setting time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotatable-cassette-type feeding device for use in an image forming apparatus comprising:

paper accommodation means for housing sheets of paper, which is rotated either to a longitudinal feeding station for feeding sheets of paper to the image forming apparatus in a length-wise direction or to a lateral feeding station for feeding sheets of paper thereto in a width-wise direction;

rotation driving means for rotating the paper accommodation means between the longitudinal feeding station and the lateral feeding station of the sheets of paper;

drive control means for controlling the rotation driving means in its rotation speed in such a manner that, during a state wherein no image forming process is required, the paper accommodation means is rotated at a speed that is lower than that marked during an image forming operation.

2. The rotatable-cassette-type feeding device as set forth in claim 1, wherein the drive control means comprising:

a first power source for supplying a first driving voltage to the rotation driving means;

a second power source for supplying a second driving voltage that is lower than the first driving voltage to the rotation driving means; and power source switching means for switching supply of the driving voltage between the first power source and the second power source in such a manner that the first driving voltage is supplied to the rotation driving means during the image forming operation while the second driving voltage is supplied to the rotation driving means during the state wherein no image forming process is required.

3. The rotatable-cassette-type feeding device as set forth in claim 1, wherein the rotation driving means comprising:

driving means for generating a driving force to rotate the paper accommodation means; and transmission means for transmitting the driving force of the driving means to the paper accommodation means.

4. The rotatable-cassette-type feeding device as set forth in claim 3, wherein the driving means is a motor, and the transmission means comprising:

a threaded shaft that is rotated by the motor; and a nut member that is in mesh with the threaded shaft, the nut member being reciprocally moved along the threaded shaft by rotation of the threaded shaft.

5. The rotatable-cassette-type feeding device as set forth in claim 1, further comprising:

fixed paper accommodation means for feeding sheets of paper to the image forming apparatus in a fixed direction, wherein a plurality of the paper accommodation means including the fixed paper accommodation means are provided.

6. The rotatable-cassette-type feeding device as set forth in claim 5 comprising:

selection input means for selecting and specifying a desired paper accommodation means to feed paper among the plurality of the paper accommodation means.

7. The rotatable-cassette-type feeding device as set forth in claim 6, further comprising:

rotation start input means which, if a rotatable paper accommodation means is selected by the selection input means, instructs the rotatable paper accommodation means to start rotating in the desired direction.

8. The rotatable-cassette-type feeding device as set forth in claim 1, further comprising:

time counting means for counting a time gap between starts, which is a period of time from the start of the rotation of the rotation driving means to the start of preparatory processes for providing well-organized copying operation;

setting time storing means for storing setting time that is set based on a difference between the time required for the rotation between longitudinal and lateral feeding stations in the paper accommodation means and the time required for the preparatory processes; and time comparison means for comparing the time gap between starts provided from the time counting means with the setting time stored in the setting time storing means, wherein the drive control means controls the paper accommodation means according to the comparison results of the time comparison means in such a manner that, if the time gap between starts is shorter than the setting time, the paper accommodation means is rotated at a speed lower than a normal speed, whereas, if the time gap between starts is longer than the setting time, the paper accommodation means is rotated at the normal speed.

9. A method whereby the rotatable-cassette-type paper feeding device controls the rotation of the paper accommodation means, comprising the steps of:

once an feeding operation has been specified by selecting the size and feeding direction of sheets of paper, making a judgement as to whether or not the feeding operation is executed by a rotatable paper accommodation means;

if the feeding operation is executed by a rotatable paper accommodation means, making a judgement as to whether or not there is an instruction for an image forming operation;

if there is no instruction for an image forming operation, making a judgement as to whether or not there is an instruction for rotation of the paper accommodation means; and if there is an instruction for rotation of the paper accommodation means, rotating the paper accommodation means at a speed lower than a normal speed.

10. The control method as set forth in claim 9, further comprising the step of:

if there is an instruction for an image forming operation, rotating the paper accommodation means at the normal speed.

11. A method whereby the rotatable-cassette-type paper feeding device controls the rotation of the paper accommodation means, comprising the steps of:

once a feeding operation has been specified by selecting the size and feeding direction of sheets of paper, making a judgement as to whether or not the feeding operation is executed by a rotatable paper accommodation means;

if the feeding operation is executed by a rotatable paper accommodation means, making a judgement as to whether or not the paper accommodation means is set in the selected feeding direction;

if the paper accommodation means is not set in the selected feeding direction, making a judgement as to whether or not the paper accommodation means is set in the direction different from the selected feeding direction; and if the paper accommodation means is set in the direction different from the selected feeding direction, starting to count using a timer as well as rotating the paper accommodation means at a speed lower than a normal speed.

12. The control method as set forth in claim 11, further comprising the step of:

if the paper accommodation means is not set in the direction different from the selected feeding direction, judging that the selected sheets of paper are not stored in the paper accommodation means, thereby providing a warning display so as to indicate the judgement.

13. The control method as set forth in claim 11, further comprising the steps of:

upon receiving an instruction for starting an image forming operation, making a judgement as to whether or not the rotation of the paper accommodation means has been completed after having started preparatory processes of an image forming operation;

if the rotation of the paper accommodation means has not been completed, comparing a time gap between starts, that is, a period of time from the start of the rotation of the rotation driving means to the start of the preparatory processes, which has been counted by the timer, with the setting time that is set based on a difference between the time required for the rotation between longitudinal and lateral feeding stations in the paper accommodation means and the time required for the preparatory processes; and if the time gap between starts is not more than the setting time, switching the rotation of the paper accommodation means from the low speed to the normal speed.

14. The control method as set forth in claim 13, further comprising the step of:

if the time gap between starts is not less than the setting time, continuing the rotation of the paper accommodation means at the low speed.

* * * * *